US011807963B2

(12) United States Patent
Gualtieri et al.

(10) Patent No.: US 11,807,963 B2
(45) Date of Patent: Nov. 7, 2023

(54) METHOD FOR PRODUCING NON-WOVEN ELEMENTS CONTAINING GRAPHENE AND/OR GRAPHENE OXIDE

(71) Applicant: Fameccanica.Data S.p.A., San Giovanni Teatino (IT)

(72) Inventors: Diego Gualtieri, San Giovanni Teatino (IT); Gabriele Biagio Antonelli, San Giovanni Teatino (IT)

(73) Assignee: Fameccanica.Data S.p.A., San Giovanni Teatino (IT)

( * ) Notice: Subject to any disclaimer, the term of this patent is extended or adjusted under 35 U.S.C. 154(b) by 147 days.

(21) Appl. No.: 17/393,903

(22) Filed: Aug. 4, 2021

(65) Prior Publication Data

US 2022/0049388 A1 Feb. 17, 2022

(30) Foreign Application Priority Data

Aug. 11, 2020 (IT) ..... 102020000019963

(51) Int. Cl.

| | |
|---|---|
| ***D04H 1/413*** | (2012.01) |
| ***D04H 1/407*** | (2012.01) |
| ***D04H 1/425*** | (2012.01) |
| ***D04H 1/732*** | (2012.01) |
| ***D01G 23/00*** | (2006.01) |
| ***D04H 1/736*** | (2012.01) |
| ***D06M 11/74*** | (2006.01) |
| ***D04H 3/16*** | (2006.01) |

(52) U.S. Cl.

CPC ..... *D04H 1/413* (2013.01); *D01G 23/00* (2013.01); *D04H 1/407* (2013.01); *D04H 1/425* (2013.01); *D04H 1/732* (2013.01); *D04H 1/736* (2013.01); *D04H 3/16* (2013.01); *D06M 11/74* (2013.01)

(58) Field of Classification Search

CPC ..... D04H 1/407; D04H 1/413; D04H 1/732

See application file for complete search history.

(56) References Cited

U.S. PATENT DOCUMENTS

| | | | | |
|---|---|---|---|---|
| 4,915,897 | A * | 4/1990 | Farrington | A61F 13/15642 425/81.1 |
| 4,921,659 | A * | 5/1990 | Marshall | A61F 13/15658 264/510 |
| 4,927,582 | A * | 5/1990 | Bryson | A61F 13/15658 425/81.1 |
| 6,533,978 | B1 * | 3/2003 | Wisneski | A61F 13/534 425/81.1 |
| 2002/0155776 | A1 * | 10/2002 | Mitchler | D04H 1/732 442/357 |
| 2013/0108831 | A1 * | 5/2013 | Wu | D04H 1/54 428/161 |

(Continued)

FOREIGN PATENT DOCUMENTS

| | | |
|---|---|---|
| CN | 111041710 A | 4/2020 |
| CN | 111334930 A | 6/2020 |

(Continued)

OTHER PUBLICATIONS

Italian Search Report dated Apr. 23, 2021. 10 pages.

*Primary Examiner* — Mary Lynn F Theisen
(74) *Attorney, Agent, or Firm* — RMCK Law Group PLC

(57) ABSTRACT

A method and apparatus for producing non-woven elements, including a body of bonded fibers in which graphene and/or graphene oxide is incorporated.

5 Claims, 2 Drawing Sheets

(56) References Cited

U.S. PATENT DOCUMENTS

| | | | | |
|---|---|---|---|---|
| 2014/0270994 | A1* | 9/2014 | Gualtieri | B05C 19/06 406/82 |
| 2017/0121559 | A1 | 5/2017 | Jung et al. | |
| 2020/0362478 | A1* | 11/2020 | Dilo | D04H 1/736 |
| 2023/0114465 | A1* | 4/2023 | Seven | B01J 20/28026 523/209 |

FOREIGN PATENT DOCUMENTS

| | | | |
|---|---|---|---|
| CN | 111648036 | A | 9/2020 |
| EP | 0301772 | A3 | 5/1990 |
| WO | 9831858 | A2 | 7/1998 |

* cited by examiner

METHOD FOR PRODUCING NON-WOVEN ELEMENTS CONTAINING GRAPHENE AND/OR GRAPHENE OXIDE

CROSS-REFERENCE TO RELATED APPLICATION

This application claims priority to Italian Patent Application No. 102020000019963 filed Aug. 11, 2020. The disclosure of the above application is incorporated herein by reference in its entirety.

FIELD OF THE INVENTION

The present invention relates to a method for producing non-woven elements containing graphene and/or graphene oxide.

The invention was developed in particular with a view to its application for producing absorbent sanitary articles such as, for example, diapers and diaper-pants for children, incontinence pads for adults, sanitary towels for women, and similar articles intended to absorb body fluids.

In the following description, reference will be made to this field of use without, however, losing generality. In fact, it is understood that the present invention can be used in general in all cases wherein non-woven elements are used, for example, for producing face protection masks, possibly functionalized plasters for dressing wounds and/or lesions, heating plasters, sanitary bandages or bands, elements for packaging of products, articles for cleaning surfaces such as disposable cloths, napkins or other dust-catching articles.

In the following description and in the claims, it is intended that graphene oxide also comprises reduced graphene oxide.

DESCRIPTION OF THE PRIOR ART

Graphene is a material consisting of a monoatomic layer of carbon atoms, which can be produced by mechanical exfoliation of graphite, liquid phase exfoliation, graphene oxide reduction or by chemical treatment of graphite. Graphene is used in various fields of the art due to its characteristics of mechanical strength, electrical conductivity and ability to capture particles, bacteria, etc.

In recent years there has been a growing interest in the development of methods for producing non-woven elements containing graphene and/or graphene oxide.

However, the prior art has not been able to propose solutions that would allow the production of non-woven materials wherein graphene and/or graphene oxide can be incorporated and trapped in the non-woven volume.

Some solutions involve the use of glues or other chemical composites designed to bind graphene or its oxides exclusively on the outer surface of the non-woven materials.

In addition to requiring the use of expensive and in some cases contaminating binders, these solutions are now not very sustainable, especially in terms of recycling the non-woven material.

In any case, these known solutions allow obtainment of non-woven materials with graphene present only in the surface layer, which by its nature can be dispersed as it is not effectively trapped in the fibers of the non-woven material.

Other solutions involve completely immersing a non-woven material in liquid solutions of graphene.

However, these solutions, in addition to being slow for the current production standards of non-woven webs as they require dedicated drying systems, have multiple imperfections that often prevent their use in fields where a high precision of the elements is required for producing products, as in the case of absorbent sanitary articles or plasters.

In this context, therefore, the need has materialized to provide a solution capable of rapidly producing non-woven elements functionalized with graphene and/or graphene oxide wherein the latter is effectively trapped in the non-woven volume.

OBJECT AND SUMMARY OF THE INVENTION

The present invention aims to provide a method for producing non-woven elements containing graphene and/or graphene oxide which are particularly suitable in the field of producing absorbent sanitary articles and face protection masks.

According to the present invention, this object is achieved by a method having the characteristics forming the subject of claim 1.

The claims form an integral part of the technical disclosure provided in relation to the invention.

The present invention involves producing an element of loose unbound fibers in which particles of graphene and/or graphene oxide are dispersed and possibly mixed. These loose unbound fibers comprising graphene and/or graphene oxide are then bound together so that the graphene and/or graphene oxide particles are effectively trapped in the volume of the bonded fibers. The loose unbound fibers are bound together with graphene and/or graphene oxide through thermal processes (hot air or calendering), mechanical processes (needling), chemical processes (for example, by resins), electrical processes (by electric fields capable of polarizing the fibers and/or the graphene and/or graphene oxide so that they bind electrostatically to each other), or other processes.

According to the present invention, the resulting non-woven elements have better thermal and electrical conductivity characteristics than other non-woven elements with graphene made with prior art techniques. This aspect may be useful if these elements are to be welded to other webs or other components of the products to be made, as the energy required to weld the webs together is lower than that typically required for normal non-woven elements, even if they have graphene on the surface. In fact, the high thermal conductivity makes it possible to effectively distribute energy near the welding area.

According to the present invention, the resulting non-woven elements have better antibacterial, antimicrobial and fungicidal characteristics than other non-woven elements with graphene made with prior art techniques. The presence of graphene and or graphene oxide in the non-woven volume increases the antibacterial action, as well as the other aforesaid actions, in a wider area than that of non-woven materials functionalized in a known way, as the antibacterial action, as well as the other aforesaid actions, is not limited exclusively to the surface, but is also extended in the non-woven volume.

Similar considerations may also be made for further functionalizing effects of the graphene and/or graphene oxide, such as the filtering effects of particles, anti-odor effects, hydrophobic or hydrophilic effects, or mechanical resistance. All these effects are significantly better in a non-woven element made according to the present invention since the graphene and/or graphene oxide particles are trapped in the non-woven volume.

Loose unbound fibers may be deposited using a 3D Lofting process, a technology developed by the Dilogroup company, which uses high pressure air flows to convey the fibers and deposit them precisely on a movable porous support connected to a suction source.

Alternatively, the loose fibers may be deposited by a carding process.

The particles of graphene and/or graphene oxide may be added to the loose unbound fibers with the aid of electromagnetic fields that allow effective coupling of the loose unbound fibers to the graphene and/or graphene oxide particles.

The use of electromagnetic fields is particularly effective if intending to functionalize the non-woven element to be hydrophilic or hydrophobic, as these fields, in addition to binding the fibers with graphene and/or graphene oxide, also act as polarizers. A synergistic effect may, therefore, be obtained as the polarization of the fibers and thus their functionalization to be hydrophilic or hydrophobic is further facilitated thanks to the electromagnetic properties of graphene and/or graphene oxide.

The method according to the present invention may be used to produce discrete non-woven elements directly in the production line of absorbent sanitary articles as well as for the off-line production of non-woven webs collected in reels.

Producing non-woven elements directly in the production line of absorbent sanitary articles starting from unbound fibers avoids the need to provide unwinders of raw materials from reels, and allows different structures to be obtained that are bound in the required way without being restricted to the availability of suppliers of raw materials in reels. Furthermore, the formation of discrete non-woven elements in line allows also the creation of elements with shaped structures that cannot be made using ATB non-woven webs or other high loft webs.

BRIEF DESCRIPTION OF THE DRAWINGS

The invention will now be described in detail with reference to the attached drawings, given purely by way of non-limiting example, wherein.

DETAILED DESCRIPTION

Figure 1:
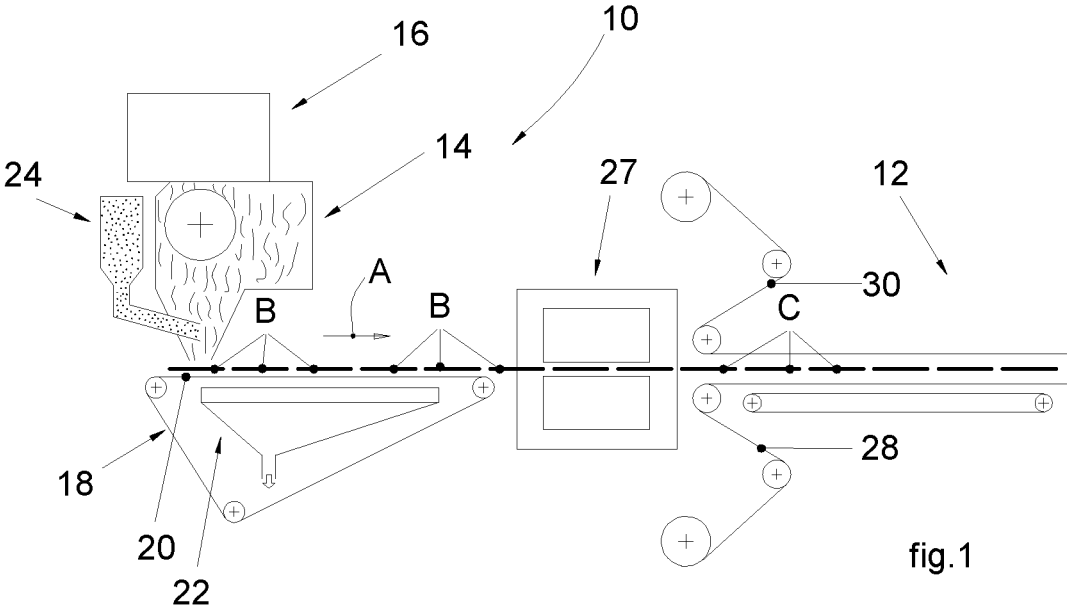
FIG. 1 is a schematic view of a first embodiment of an apparatus for producing discrete non-woven elements according to the present invention.

With reference to FIG. 1, numeral 10 indicates an apparatus for producing discrete non-woven elements according to the present invention.

The apparatus 10 is arranged in line with respect to an assembly machine 12 configured for producing absorbent sanitary articles. The assembly machine 12 is represented only schematically in the figures, and it is understood that it can be made according to any one of the known architectures in the field of producing absorbent sanitary articles. The assembly machine 12 may be configured to operate according to the Machine Direction production technique, in which the absorbent sanitary articles being formed advance with their prevailing development direction aligned with the machine direction, or according to the Cross Machine Direction production technique, in which the absorbent sanitary articles being formed advance with their prevailing direction of development transversal with respect to the machine direction. The machine 12 is formed by a set of apparatuses and devices which carry out the assembly of the different components of the absorbent sanitary articles. In particular, the machine 12 may be configured to assemble together: absorbent cores, topsheet and backsheet layers, elasticated waist bands, elastic elements for the legs (leg cuffs), side panels, closure formations, and any other component necessary for producing absorbent sanitary articles, as is well known in the field.

For the purposes of the present invention, the constructional details of the assembly machine 12 are not relevant. What is relevant for the purposes of the present invention is that the apparatus 10 for producing absorbent cores is arranged in line with the assembly machine 12, which carries out the assembly of the absorbent cores with the other components of the absorbent sanitary articles.

The apparatus 10 comprises a fiber deposition unit 14 configured to deposit loose unbound fibers coming from a fiber stock 16 onto a movable surface. In a possible embodiment, the deposition of the loose fibers may be carried out with a 3D lofting process developed by the Dilogroup company. The deposition process of fibers called 3D lofting involves generating high pressure air flows that transport the loose fibers and orient them. The high-pressure air flows project the loose fibers onto a movable suction surface. The combination of high-pressure air jets and the suction to which the target movable surface is subjected allow obtainment of three-dimensional formations of the loose fibers with high precision.

The construction details of a fiber deposition unit 14 operating according to the 3D lofting process are described in detail in documents EP-A-3450603 and EP-A-3450604.

The fibers used in the method according to the present invention are fibers normally used for producing non-woven materials and may be:

- synthetic fibers such as polyester, polyethylene, polypropylene, polyurethane, polyamide, acrylate, cellulose acetate, cupro, lyocell, modal, viscose or rayon, or their mixtures, or
- natural fibers such as cotton, linen, hemp, jute, ramie, coconut, pineapple, gorse, hibiscus, straw, bamboo, soy, kapok, eucalyptus, or their mixtures.

The fibers used in the method according to the present invention may be fibers without cellulose fluff (defibrated cellulose). In possible embodiments, the loose unbound fibers may be mixed with cellulose fluff.

The deposition of the loose unbound fibers may be carried out on a movable surface fluidically connected to a suction source. In a possible embodiment, the deposition of the loose unbound fibers may be carried out on a porous conveyor belt 18 having an upper branch 20 facing a suction chamber 22 connected to a source of sub-atmospheric pressure. In possible embodiments, the fiber deposition unit may deposit the fluff-free loose unbound fibers on the outer surface of a forming wheel as in standard processes for forming absorbent cores based on cellulose fluff, as described, for example, in EP-B1-2775975.

The conveyor belt or the forming wheel may be provided with pockets in which the fibers are deposited. These pockets may be shaped to form one or more substantially fiber-free channels in the absorbent core.

The loose unbound fibers may be deposited on a porous substrate, formed for example by a non-woven web, which advances on a conveyor belt or on the outer surface of a forming wheel, as in traditional processes for producing absorbent cores based on cellulose fluff. Therefore, the process step of the present invention that involves depositing loose, unbound fibers on a movable surface includes both the case wherein the movable surface is the surface of a conveyor belt or of a forming wheel and the case wherein the movable surface is the surface of a movable substrate.

The fiber deposition unit 14 may be configured to deposit the loose unbound fibers onto a movable surface to form a continuous array of blanks B advancing in the machine direction indicated by the arrow A. The blanks B may be oriented with their prevailing direction of development parallel or transverse to the machine direction A.

The blanks B may have a rectangular shape or may be shaped according to profiles of various types. The blanks B may be provided with longitudinal or transverse channels, and may also have a three-dimensional conformation in the Z direction. The blanks B may be made of fibers of different types (layered, mixed or different colors). The blanks B may be formed with a variable density layering both in the Z direction and in the direction transverse to the machine direction A.

The apparatus 10 comprises a dispensing device 24 configured to deliver metered quantities of graphene or graphene oxide.

In possible embodiments, graphene or graphene oxide may be in the form of a powdered material. In other embodiments, graphene or graphene oxide may be in the form of a liquid solution that can be sprayed onto the loose, unbound fibers.

The graphene and/or graphene oxide may be incorporated within polymeric materials, which may be dispensed into the fibers by means of dispensers of the type commonly used in machines for producing absorbent sanitary articles.

In a possible embodiment, the graphene and/or graphene oxide may be chemically bonded with superabsorbent polymers. Superabsorbent polymers and graphene and/or graphene oxide bond well with each other. Tests carried out by the Applicant have shown that there is the possibility of making polymer particles with graphene and/or graphene oxide incorporated within them, (for example, with a percentage of 10%).

Another possibility for depositing particles of graphene and/or graphene oxide on the fibers is to press the particles of graphene and/or graphene oxide against the fibers, according to a prior art known as printing. The pressing of the graphene and/or graphene oxide particles against the fibers can be carried out in a press. The press may be heated and have jets of air coming out of the press surface to push the graphene or graphene oxide particles into the volume of the fibers.

In the embodiment illustrated in FIG. 1, the dispensing device 24 is arranged to dispense the powder material into the loose, unbound fibers before the fibers are deposited on the movable surface. In this embodiment, the fiber deposition unit 14 deposits loose unbound fibers mixed with graphene or graphene oxide powder onto the movable surface. The powder material may be mixed with the loose unbound fibers within a forming chamber, or flows of loose unbound fibers and flows of powder material may be formed which cross each other prior to deposition of the fiber mixture and powder material. In this way, the blanks B deposited on the movable surface comprise a mixture of loose unbound fibers and powdered graphene or graphene oxide.

The loose unbound fibers to which graphene or graphene oxide has been added undergo a binding process in which the fibers are bound together by incorporating the graphene or graphene oxide between the bonded fibers.

The process of binding the fibers, following the process of depositing the fibers and applying graphene or graphene oxide in powder form, is carried out by passing the blanks B through a fixing unit 27. The fixing of the fibers may be carried out by means of thermal or mechanical processes of the type used for fixing the fibers of the non-woven webs. For example, the fixing of the fibers may be carried out by means of flows of hot air that weld the fibers together, according to a process known as air fixing (Air Through Bonding or ATB) or by passing loose unbound fibers added to powdered graphene or graphene oxide between heated calender rollers. The fixing of the fibers may also be carried out by means of needle punching or similar cold mechanical fixing processes, which carry out mechanical binding and anchoring of the fibers. By controlling the degree of attachment of the fibers, it is possible to define areas of the cores with variable integrity both in the Z direction and in the transverse direction.

At the outlet of the fixing unit 27, a continuous array of non-woven elements C is obtained, having a body formed by bonded fibers and powdered graphene or graphene oxide distributed between the bonded fibers, wherein the graphene or graphene oxide powder is dispersed between the fibers before fixing of the fibers.

The non-woven elements C are supplied in line to the assembly machine 12. For example, the finished elements C at the outlet of the fixing unit 27 may be enclosed between a backsheet layer 28 and a topsheet layer 30, as is customary in the production of absorbent sanitary articles.

Figure 2:
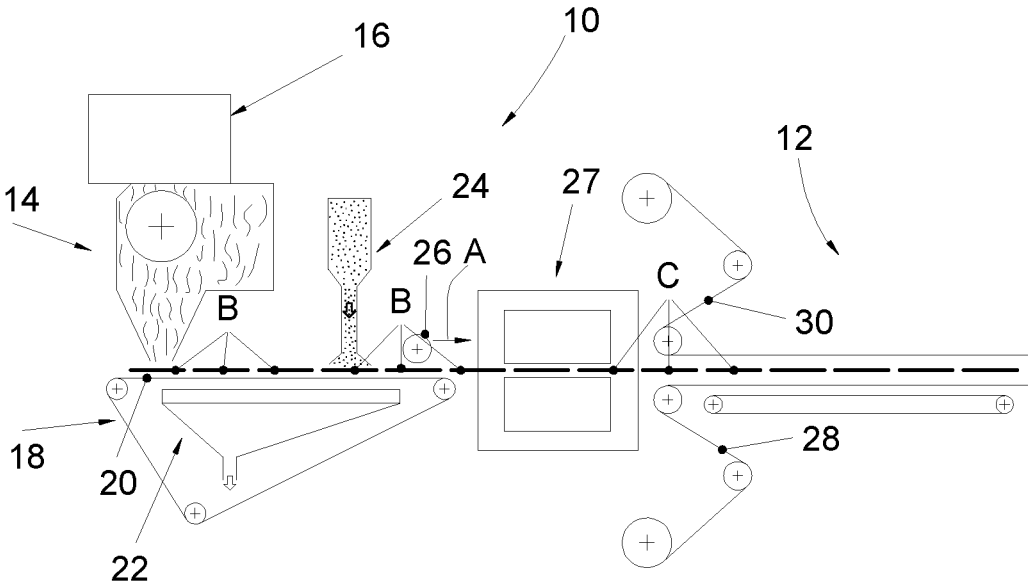
FIGS. 2, 3 and 4 are schematic views illustrating a second, a third and a fourth embodiment of an apparatus for producing discrete non-woven elements according to the present invention.
Figure 3:
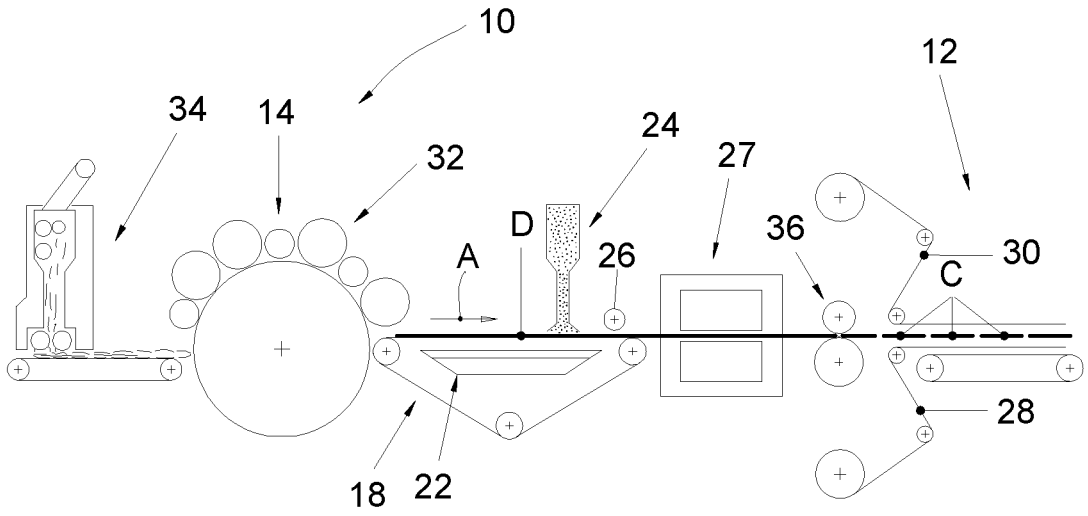
Figure 4:
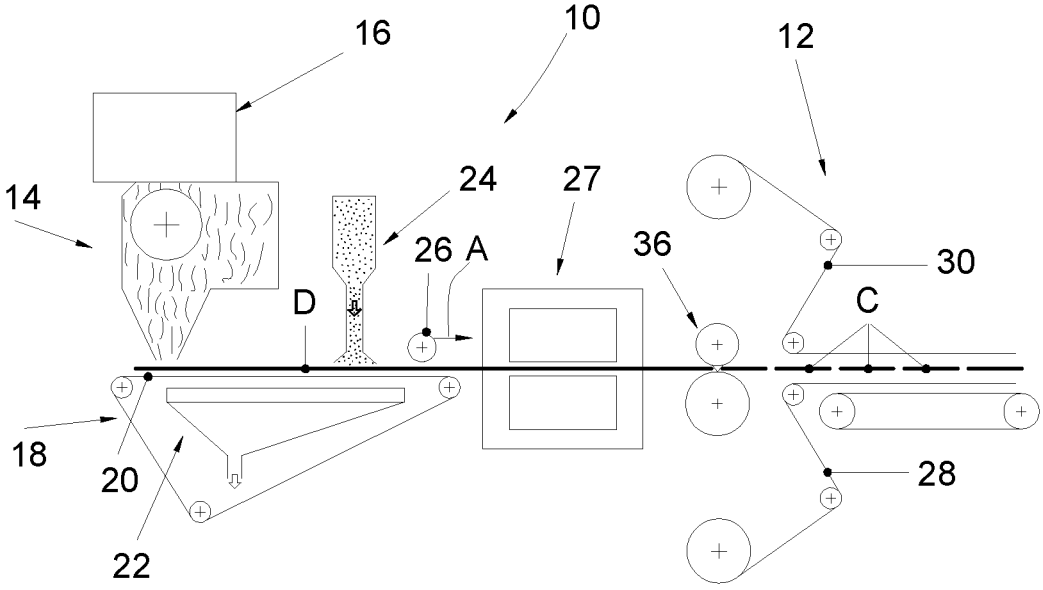

FIGS. 2, 3 and 4 illustrate a second, a third and a fourth embodiment of an apparatus for producing discrete non-woven elements according to the present invention. The elements corresponding to those previously described are indicated with the same numerical references.

In the embodiment illustrated in FIG. 2, the fiber deposition unit 14 forms blanks B, on the movable surface, composed of loose unbound fibers and free from graphene or graphene oxide in powder form. A dispensing device 24 is arranged downstream of the fiber deposition unit 14, with reference to the machine direction A, and delivers powdered graphene or graphene oxide onto the blanks of absorbent cores B. Powdered graphene or graphene oxide may be arranged in layers, alternating layers of loose unbound fibers deposited by one or more fiber deposition units 14 with layers of powdered graphene or graphene oxide deposited by one or more dispensing devices 24.

The blanks B on which graphene or graphene oxide powder has been deposited may be subjected to a mixing step carried out in a mixing unit 26 configured to mix the graphene or graphene oxide powder with the loose unbound fibers. The mixing unit 26 may comprise: rotating brushes, gears, electrostatic devices, air jets, water jets, etc. The mixing unit may also be provided in the embodiment of FIG. 1, even if in this case the powdered graphene or graphene oxide has already been mixed with the loose fibers before their deposition.

In the embodiment illustrated in FIG. 3, the fiber deposition unit 14 comprises a card 32 fed by a fiber loader 34. The card 32 produces a continuous web of loose unbound fibers D, which is deposited onto a movable surface, for example, onto a suction conveyor 18. A dispensing device 24 is arranged to dispense graphene or graphene oxide in powder form into the loose unbound fibers of the continuous web D as it advances in the machine direction A. Downstream of the dispensing device 24, a mixing unit 26 may be arranged which favors the distribution of graphene or graphene oxide powder between the loose fibers of the continuous web D. The continuous web of loose unbound fibers D in which the graphene or graphene oxide powder has been distributed is passed through a fixing unit 27 to fix the fibers. At the outlet of the fixing unit 27, a continuous web of bonded fibers is obtained containing graphene or graphene oxide powder distributed between the bonded fibers. The continuous web of bonded fibers may be cut in a transverse direction by a cutting unit 36, which produces a continuous array of discrete absorbent cores C. The discrete absorbent cores C are supplied in line to an assembly machine 12 as described above.

In the embodiment illustrated in FIG. 4, a fiber deposition unit 14, for example, a 3D lofting fiber deposition unit, deposits a continuous web of loose unbound fibers D. The continuous web of loose unbound fibers D may already have graphene or graphene oxide powder added at the outlet of the fiber deposition unit 14, or the graphene or graphene oxide powder may be applied by a dispensing device 24 located downstream of the fiber deposition unit 14. The 3D lofting fiber deposition technique allows a continuous web D with shaped sides to be formed. The continuous web of loose unbound fibers D with added graphene or graphene oxide powder is passed through a fixing unit 27 to fix the fibers as in the embodiment of FIG. 3. Then, the continuous web of bonded fibers may be cut in a transverse direction by a cutting unit 36, which produces a continuous array of discrete absorbent cores C. The discrete non-woven elements C are supplied in line to an assembly machine 12 as described above.

The main technical advantage connected to the production of discrete elements C with the methods described above is the possibility of better incorporating the particles of graphene or graphene oxide powder between the fibers, because the particles of graphene or graphene oxide powder are incorporated in the loose unbound fibers before the fibers are fixed together.

The discrete non-woven elements C thus produced are more intact than a traditional non-woven product containing powdered material, both in dry and wet conditions.

These methods make it possible to reduce the amount of glue, and make it possible to produce glue-free elements, defined as elements containing an amount of glue less than 20% of the total amount of glue applied to the absorbent sanitary article. Under certain conditions, the glue can be completely eliminated.

Although producing discrete non-woven elements in line is particularly advantageous, the present invention may also be used for producing continuous non-woven webs away from the assembly line, which are collected in reels for their subsequent use in a production line.

Of course, without prejudice to the principle of the invention, the details of construction and the embodiments may be varied, with respect to that described, purely by way of non-limiting example, without thereby departing from the scope of the invention as defined by the following claims.

The invention claimed is:

1. A method for producing non-woven elements, comprising:

depositing loose unbound fibers on a movable surface and providing graphene and/or graphene oxide, and binding together said loose unbound fibers so as to form a structure of bound fibers in which at least the graphene and/or graphene oxide is incorporated, wherein the loose unbound fibers and granular superabsorbent polymer are deposited onto said movable surface, and wherein the graphene and/or graphene oxide is incorporated into said granular superabsorbent polymer.

2. The method of claim 1, wherein the graphene and/or graphene oxide is deposited on said loose unbound fibers after depositing the loose unbound fibers onto said movable surface.

3. The method of claim 1, wherein the loose unbound fibers are deposited by projecting the loose unbound fibers by pressurized air jets onto the movable surface or another surface fluidically connected to a suction source.

4. The method of claim 1, wherein the loose unbound fibers are deposited onto said movable surface so as to form an array of blanks of discrete elements.

5. A method for producing non-woven elements, comprising:

depositing loose unbound fibers on a movable surface and providing graphene and/or graphene oxide, and binding together said loose unbound fibers so as to form a structure of bound fibers in which at least the graphene and/or graphene oxide is incorporated, wherein the graphene and/or graphene oxide is coupled to said loose unbound fibers by electromagnetic fields.

* * * * *